US006311886B1

(12) United States Patent
Alexander et al.

(10) Patent No.: US 6,311,886 B1
(45) Date of Patent: Nov. 6, 2001

(54) POSITION AND DIRECTION SENSING SYSTEM FOR AN INSPECTION AND HANDLING SYSTEM

(75) Inventors: Steven J. Alexander, Milwaukee; Jon Ubert, New Berlin, both of WI (US)

(73) Assignee: Robotic Vision Systems, Inc., Canton, MA (US)

( * ) Notice: Subject to any disclaimer, the term of this patent is extended or adjusted under 35 U.S.C. 154(b) by 0 days.

(21) Appl. No.: 09/434,116

(22) Filed: Nov. 4, 1999

Related U.S. Application Data

(60) Provisional application No. 60/107,370, filed on Nov. 6, 1998.

(51) Int. Cl.[7] ..... B65H 26/00
(52) U.S. Cl. ..... 226/45; 226/2
(58) Field of Search ..... 226/2, 45, 42, 226/43, 128

(56) References Cited

U.S. PATENT DOCUMENTS 4,460,421 * 7/1984 Booth et al. ..... 156/64
4,485,949 * 12/1984 Gebhart et al. ..... 226/2
5,020,959 * 6/1991 Soth ..... 414/416
5,027,993 * 7/1991 Ferguson ..... 226/45 X
5,191,693 * 3/1993 Umetsu ..... 29/429
5,410,124 * 4/1995 Jackson ..... 226/45 X
5,725,140 * 3/1998 Weber et al. ..... 226/128 X
6,032,845 * 3/2000 Piccone et al. ..... 226/128 X
6,206,263 * 3/2001 Rich et al. ..... 226/45 X

* cited by examiner

*Primary Examiner*—Donald P. Walsh
*Assistant Examiner*—Minh-Chau Pham
(74) *Attorney, Agent, or Firm*—Michael Best Friedrich LLP

(57) ABSTRACT

The invention provides a pick and place system having a taper module that determines both placement and direction of the carrier tape by optically counting sprocket holes as they move in either direction. Compartments in a carrier tape are serially spaced along the longitudinal axis of the tape. The tape also includes a plurality of sprocket holes serially spaced along a line that is parallel to the longitudinal axis of the tape. The distance between compartments corresponds to a predetermined number of sprocket holes. Two optical couplers are set at a predetermined distance smaller than the s pacing between consecutive sprocket holes. Signals from the couplers will have a unique sequence depending on the direction of the tape. By using direction and number of sprocket holes, the exact position of the tape can be determined.

13 Claims, 2 Drawing Sheets

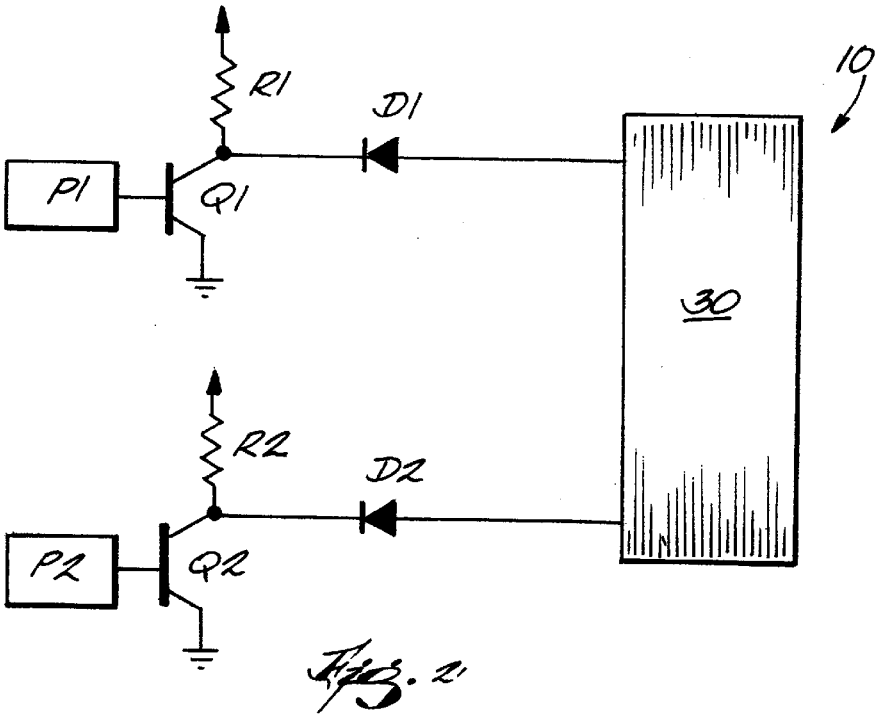
Fig. 2
Fig. 1
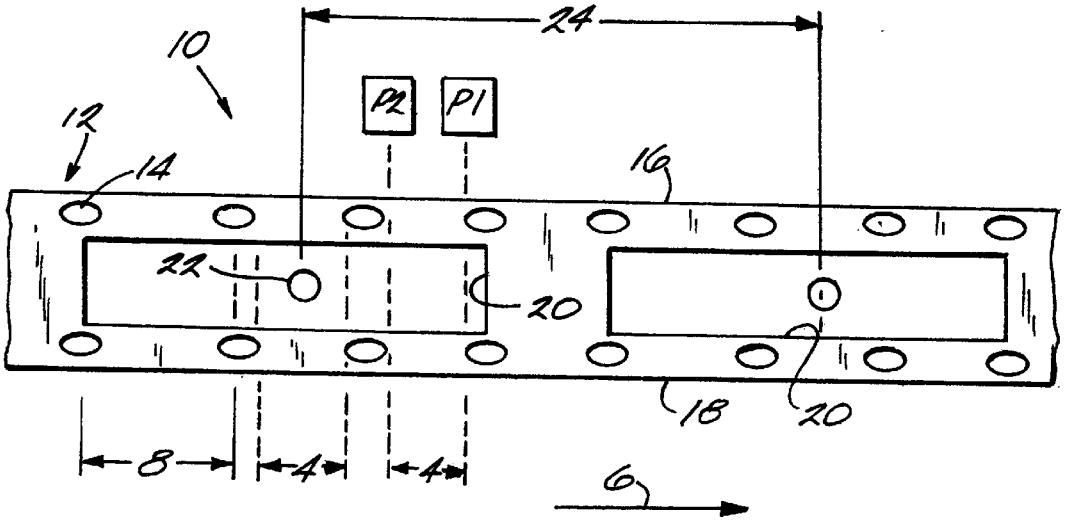

POSITION AND DIRECTION SENSING SYSTEM FOR AN INSPECTION AND HANDLING SYSTEM

RELATED APPLICATION

This application claims the benefit under 35 U.S.C. §119 of co-pending U.S. Provisional Patent Application Ser. No. 60/107,370, filed Nov. 6, 1998.

FIELD OF THE INVENTION

The invention relates to a position sensing system, and more particularly, to a position sensing system for use in a taper module of an inspection and handling system for devices such as semiconductors.

BACKGROUND OF THE INVENTION

Some devices, such as integrated circuit chips, need to be precisely fabricated. Accordingly, inspection of the devices is necessary to ascertain whether the devices meet exacting acceptance standards. The devices to be inspected are often provided in compartmented trays that have multiple rows and columns of pockets in which the devices are transported.

An inspection and handling system is utilized to inspect such devices. Trays of devices are transported through various stages of the inspection and handling system including laser scanning, inversion, camera scanning, and individual placement at a final destination so that devices meeting the exacting acceptance standards are separated from those devices which do not meet such standards.

One final destination of devices that meet the acceptance standards is carrier tape. Typically, carrier tape is an elongated tape that includes pockets that are arranged in series. The pockets are typically shaped to be complementary to the dimensions of the devices that are to be housed therein. An instrument such as a vacuum operated precisor of a pick and place system can transport a device from a tray into a pocket of the carrier tape. Once devices are individually placed into the pockets of the carrier tape, a cover tape is often applied and the carrier tape with devices housed in the sealed pockets can be wound onto a reel and conveniently transported to another destination, such as on in which the devices will be put into final use.

Pick and place systems are generally capable of motion in one direction (transverse to the direction of movement of trays through the inspection and handling system) and have limited, if any, movement in a direction perpendicular to that motion (parallel to the direction of movement of the trays). Therefore, the carrier tape needs to be incrementally moved by a drive system so that the pick and place system can place devices into successive pockets of the carrier tape. It is therefore necessary to determine the location of individual pockets of the carrier tape with respect to the pick and place system. Typically, the carrier tape includes sprocket holes that run the length of the carrier tape on one or both sides of the pockets. The sprocket holes are utilized to determine the position of a pocket relative to the pick and place system.

In some inspection and handling systems, problems may occur if the carrier tape is not consistently advanced by the proper distance equivalent to the length of one pocket. Traditionally, the beginning of a pocket is determined by forwarding the carrier tape by a fixed distance, and assuming that the carrier tape moved forward the distance programmed. Use of a sensor may also be employed to detect the number of sprocket holes passed as the carrier tape is advanced. In such systems, the drive system assumes that the point to which the carrier tape is forwarded is the correct starting point of the pocket.

Specifically, in some systems, simply advancing the carrier tape by a set distance, or counting the number of sprocket holes passed, may not be sufficiently accurate in determining the position of a pocket. Jitter or slipping of the carrier tape can occur. In the case of slipping, the carrier tape may not be advanced the amount the drive system is programmed to advance. In the case of jitter, the carrier tape may move backward, thereby counting a sprocket hole twice. Accordingly, errors may incur in determining the location of a pocket.

SUMMARY OF THE INVENTION

Known pick and place systems are incapable of determining the direction of movement of the carrier tape through the taper module. This inability to discern direction can compromise accuracy of the taper module as occasionally it is necessary to move the carrier tape in a reverse direction to precisely position the tape. Moreover, pick and place systems may be run essentially in reverse to unload devices from the pockets of the carrier tape or to load and unload carrier tape from its reel. Therefore, a system that determines both position and direction of the carrier tape improves accuracy and allows the tape module to be run in both loading and unloading modes.

Accordingly, the invention provides a pick and place system having a taper module that determines both placement and direction of the carrier tape by optically counting sprocket holes as they move in either direction.

More specifically, the carrier tape has a plurality of compartments sized to receive one semiconductor device. The compartments are serially spaced along the longitudinal axis of the tape and the tape also includes a plurality of sprocket holes serially spaced along a line that is parallel to said longitudinal axis. The distance between compartments corresponds to a predetermined number of sprocket holes. Two optical couplers are set at a predetermined distance smaller than the spacing between consecutive sprocket holes. Signals from the couplers will have a unique sequence depending on the direction of the tape. By using direction and number of sprocket holes, the exact position of the tape can be determined.

Preferably, this invention also contemplates transporting the tape by engaging the tape surfaces and not the sprocket holes, and it includes the capability of inspecting for the presence of a device in the tape compartment and proper positioning of the device in the compartment.

BRIEF DESCRIPTION OF THE DRAWINGS

FIG. 1 is a plan view, in schematic form, of a carrier tape with the position sensor.

FIG. 2 is a schematic diagram of the tape position sensing system of FIG. 1.

Figure 3A:
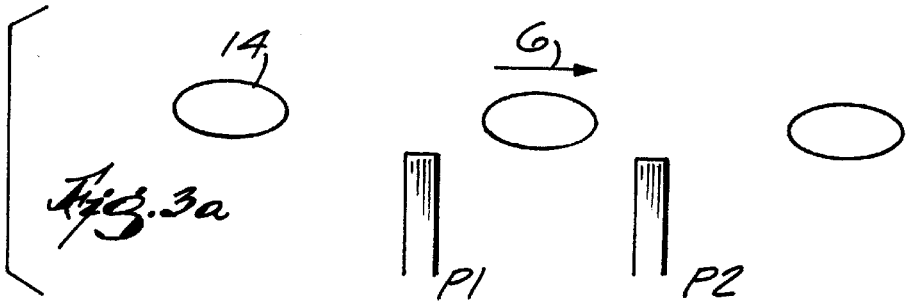
FIG. 3 is a timing diagram of the tape position sensing system of FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

The relationship of the pick and place system to the overall inspection and handling system and a taper system or module can be as set forth in co-pending U.S. Application Ser. No. 60/052,698, filed Jul. 16, 1997 and entitled "Inspection Handler Apparatus and Method" and assigned to the assignee of this application. The structure and operation of the taper system or module can be as set forth in co-pending U.S. Application Ser. No. 60/076,702, filed Mar. 4, 1998 and entitled "Position Sensing System for an Inspection and Handling System" and assigned to the assignee of this application. If details of those relationships are necessary, reliance is placed on those co-pending applications.

FIG. 1 depicts one of several types of carrier tape 12 used in the semiconductor industry and adaptable for use in this system. Rectangular shaped device pockets 20 are spaced uniformly along the longitudinal axis of the carrier tape 12. The pockets are dimensioned to fit with a particular semiconductor device and each pocket includes a central test hole 22. The distance between test holes 22 is commonly referred to as the pitch 24 of the carrier tape.

FIG. 1 also illustrates a tape position sensing system 10 that operates to determine the position of carrier tape 12.

The carrier tape 12 has a series of uniformly spaced sprocket holes 14 provided along one or both edges 16 and 18 of the carrier tape 12. The distance between consecutive sprocket holes is called the sprocket hole pitch. The sprocket holes 14 can be used as a means for driving the carrier tape 12. Typically, the sealed carrier tape provided by the tape system is unwound by the semiconductor device user using the sprocket holes 14. A plurality of pockets, such as pocket 20, are positioned sequentially along the carrier tape 12, and are dimensioned to be complementary to devices that are to be housed therein.

After devices have been housed in the pockets 20 of the carrier tape 12, the ultimate user of the devices typically will utilize the sprocket holes 14 as a means by which to move the carrier tape 12. To reduce or eliminate the risk of damage to the sprocket holes 14, it is preferable that the inspection and handling system does not utilize the sprocket holes 14 as part of the drive system. Preferably, a friction drive is utilized to move the carrier tape 12 through the taper module of the inspection and handling system.

In the present invention, a pair of conventional optical couplers P1 and P2 detects the passing of the serial sprocket holes 14 as the carrier tape 12 is advanced by the drive system. In the embodiment shown in FIG. 1, P1 and P2 are 2.5 mm apart and a pocket length is the distance between four of the sprocket holes 14. The number of sprocket holes 14 passed by the optical couplers P1 and P2 is counted by the encoder.

With reference to FIG. 1, the sprocket holes are spaced on centers 8, in the preferred embodiment 4 mm. There is a distance 4 between the leading and trailing edges of adjacent sprocket holes, that is leading and traling relative to the direction of travel of the tape illustrated by arrow 6. In the preferred embodiment, the spacing between optical couplers is equal to or less than the distance 4. Specifically in this embodiment the spacing 4 equals 2.5 mm.

With reference to FIG. 2, a circuit schematic of the tape position sensing system 10 is illustrated. The circuit processes the information received from the optical couplers P1 and P2 resulting from the detection of the passing of sprocket holes 14. Specifically, the optical couplers P1 and P2 are electrically connected to transistors Q1 and Q2. Each source of transistors Q1 and Q2 is electrically connected to a conventional microprocessor with associated hardware 30, through Schottky diodes D1 and D2.

The signals from optical couplers P1 and P2 are processed using gray code sequence (quadrature) counting. With reference to FIG. 3, a timing diagram of photocell detection and its relationship with tape movement is illustrated. A coupler is ON when positioned adjacent a sprocket hole, and is OFF when adjacent the solid portion of the tape between sprocket holes. Using the logic of zero for OFF and one for ON, the signals from the two couplers are compared.

Figure 3B:
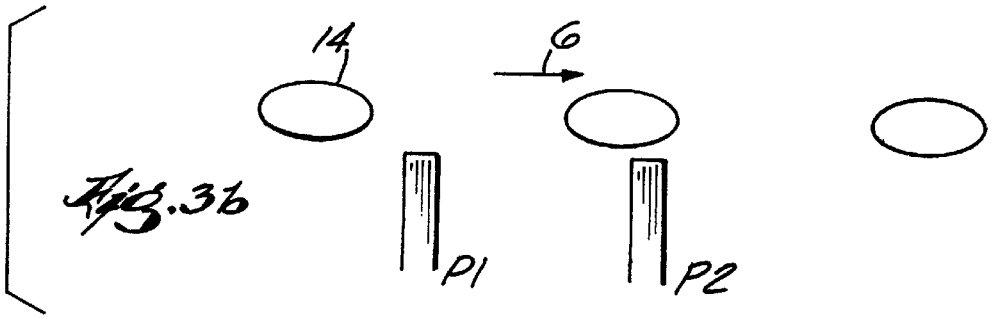
Figure 3C:
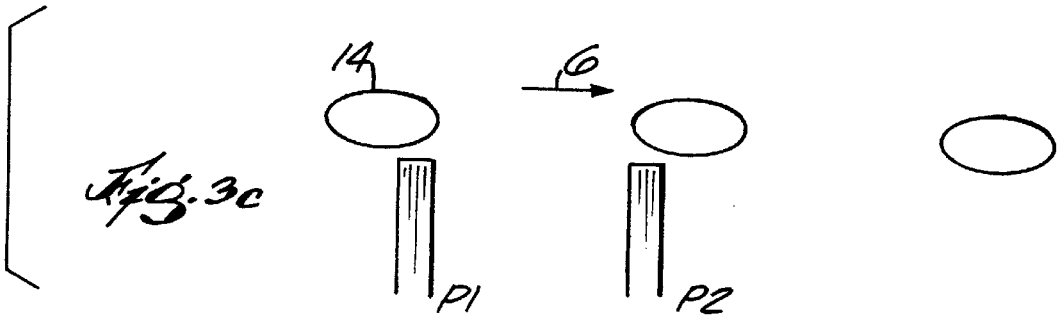
Figure 3D:
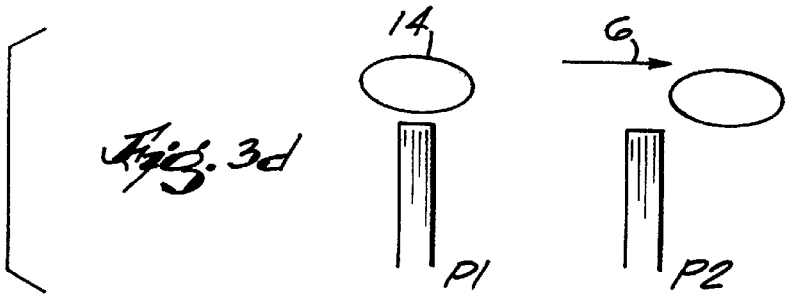

FIGS. 3*a* through 3*d* illustrate the logic sequence produced by the optical couplers for different tape positions. In FIG. 3*a*, neither optical coupler is aligned with a sprocket hole, producing two zero signals. In FIG. 3*b*, the tape has advanced a small distance, and optical coupler P1 is not aligned with a sprocket hole whereas optical coupler P2 is. This produces a zero signal and a one signal, respectively. In FIG. 3*c*, the tape has advanced further so that both optical couplers are aligned with a sprocket hole, yielding two one signals. Finally, FIG. 3*d* shows the tape advanced even further, such that optical coupler P1 is aligned with a sprocket hole and optical coupler P2 is not. This produces a one signal and a zero signal, respectively. The gray code for the tape moving in direction 6 is:

| P1 | P2 |
|---|---|
| 0 | 0 |
| 0 | 1 |
| 1 | 1 |
| 1 | 0 |

The gray code for a tape moving in a direction in the reverse of direction 6 is:

| P1 | P2 |
|---|---|
| 0 | 0 |
| 1 | 0 |
| 1 | 1 |
| 0 | 1 |

The microprocessor will determine tape direction by matching signals from the optical couplers with one of the two above-mentioned sequences.

A unique logic sequence will be generated depending on the direction of tape travel. The microprocessor both counts the number of ON signals to determine tape position, and calculates the logic sequence to determine the direction of tape travel.

The exact position of the tape is determined from the number and direction of hole movement past the optical couplers. The carrier tape can be moved very accurately in either a forward or reverse direction within the taping module. This allows the system to be run accurately in both reverse and forward directions.

Utilizing optical couplers P1 and P2 in this manner eliminates any potential jitter problems that may occur. The microprocessor can also generate an index pulse for the purpose of homing the tape.

It should also be noted that this invention can be used in any type of motion control where photo-optic sensors spaced at a pre-determined setting, based on sprocket hole spacing, can detect product movement. This could occur on any type of web fed product with sprocket holes on at least one edge.

We claim:

1. A tape position sensing system for use in the taper module of a pick and place system, the sensing system comprising:

a carrier tape having a longitudinal axis and including a plurality of compartments sized to receive one semiconductor device each, each compartment having a center point, the compartments being serially spaced along the longitudinal axis of the tape, the distance between center points of successive compartments defining a tape pitch, and a plurality of equally sized sprocket holes uniformly spaced along a line which is parallel to the longitudinal axis, the distance between successive sprocket holes defining a hole pitch, which is constant relative to the tape pitch;

two signal-producing optical couplers mounted adjacent the plurality of sprocket holes such that the optical couplers directly detect the passage of the sprocket holes, the optical couplers being spaced apart from each other a fixed distance smaller than the hole pitch; and a signal processor for interpreting signals from the optical couplers, thereby measuring actual carrier tape movement.

2. The tape position sensing system of claim 1, wherein the signal processor includes a microprocessor coupled to the optical couplers.

3. The tape position sensing system of claim 2, wherein the microprocessor is programmed to determine tape movement direction and actual tape compartment position.

4. The tape position sensing system of claim 2, wherein the microprocessor is programmed to generate an index pulse for homing the tape.

5. A method for sensing tape position in the taper module of a pick and place system, the method comprising:

providing a carrier tape including a plurality of compartments and a plurality of equally sized sprocket holes equally spaced along a line, the distance between successive sprocket holes defining a hole pitch;

positioning two optical couplers adjacent the plurality of sprocket holes and spaced apart from each other at a fixed distance different from the hole pitch;

directly detecting the sprocket holes with the optical couplers to produce signals; and interpreting the signals in a signal processor to determine the actual direction and distance of carrier tape travel.

6. The method of claim 5, wherein the act of detecting the sprocket holes includes producing a signal containing a unique logic sequence corresponding to actual tape movement direction.

7. The method of claim 5, wherein the act of interpreting includes utilizing a microprocessor to interpret the signals produced by the optical couplers.

8. The method of claim 5, wherein the tape includes a plurality of tape compartments, and wherein the act of interpreting includes utilizing a microprocessor to determine the actual position of a selected tape compartment.

9. The method of claim 3, wherein the act of detecting includes:

detecting whether a first sprocket hole is present over a first one of the optical couplers and producing a first signal corresponding to the presence or absence of the first sprocket hole;

detecting whether a second sprocket hole is present over a second one of the optical couplers and producing a second signal corresponding to the presence or absence of the second sprocket hole;

storing the first and second signal;

after detecting whether a first and second sprocket holes are present or absent over the optical couplers, moving the tape;

after moving the tape, detecting whether the first sprocket hole is present over the first one of the optical couplers and producing a new first signal corresponding to the presence or absence of the first sprocket hole;

detecting whether the second sprocket hole is present over the second one of the optical couplers and producing a new second signal corresponding to the presence or absence of the second sprocket hole; and comparing the first and second stored signal to the new first and new second signal to determine actual tape movement and direction.

10. A tape position sensing system for use in the taper module of a pick and place system, the sensing system comprising:

a carrier tape having a longitudinal axis and including a plurality of compartments sized to receive one semiconductor device each, each compartment having a center point, the compartments being serially spaced along the longitudinal axis of the tape, the distance between center points of successive compartments defining a tape pitch, and a plurality of equally sized sprocket holes uniformly spaced along a line which is parallel to the longitudinal axis, the distance between successive sprocket holes defining a hole pitch which is substantially constant relative to the tape pitch;

two signal-producing optical couplers mounted adjacent the plurality of sprocket holes such that the optical couplers directly detect the passage of the sprocket holes, the optical couplers being spaced apart from each other a fixed distance different from the hole pitch; and a signal processor for interpreting signals from the optical couplers, thereby measuring actual carrier tape movement.

11. The tape position sensing system of claim 10, wherein the signal processor further comprises a microprocessor coupled to the optical couplers.

12. The tape position sensing system of claim 11, wherein the microprocessor is programmed to determine tape movement direction and actual tape compartment position.

13. The tape position sensing system of claim 11, wherein the microprocessor is programmed to generate an index pulse for homing the tape.

* * * * *

UNITED STATES PATENT AND TRADEMARK OFFICE

CERTIFICATE OF CORRECTION

PATENT NO. : 6,311,886 B1 
DATED : November 6, 2001
INVENTOR(S) : Steven J. Alexander et al.

It is certified that error appears in the above-identified patent and that said Letters Patent is hereby corrected as shown below:

Column 6,
Line 3, "The method of claim 3" should be -- The method of claim 2 --.
Line 14, "after detecting whether a" should be -- after detecting whether the --.

Signed and Sealed this

Twenty-fifth Day of March, 2003

JAMES E. ROGAN
*Director of the United States Patent and Trademark Office*